US005427370A

United States Patent [19]

Hamblin et al.

[11] Patent Number: 5,427,370

[45] Date of Patent: Jun. 27, 1995

[54] UNIVERSAL GOLF ALIGNMENT AND SET UP TEACHING SYSTEM

[76] Inventors: Michael E. Hamblin; Samuel E. Belcher, both of 935 Hamilton-Cleves, Apt. #5-A, Hamilton, Ohio 45013

[21] Appl. No.: 283,044

[22] Filed: Jul. 29, 1994

[51] Int. Cl.[6] ..... A63B 69/36

[52] U.S. Cl. ..... 273/32 H; 434/252; 273/187 A; 273/163 A; 273/187.4; 40/299

[58] Field of Search ..... 434/252; 40/299; 273/187 A, 186.2, 187.4, 187.5, 163 R, 163 A, 164.1

[56] References Cited

U.S. PATENT DOCUMENTS

| | | | |
|---|---|---|---|
| 1,745,230 | 1/1930 | Proskauer | 40/299 X |
| 2,248,145 | 7/1941 | Wilder | 40/299 X |
| 2,372,994 | 4/1945 | Welch | 40/299 X |
| 2,382,495 | 8/1945 | Malatesta, Jr. | 273/187.2 |
| 2,503,586 | 4/1950 | Miller | 273/187.2 X |
| 2,652,251 | 9/1953 | Molinar | 273/187 R |
| 3,122,846 | 3/1964 | Trent | 434/252 |
| 3,420,529 | 1/1969 | Goranson et al. | 273/213 |
| 3,649,029 | 3/1972 | Worrell | 273/187 A X |
| 3,684,294 | 8/1972 | Champion | 273/187 A X |
| 3,824,698 | 7/1974 | Brucker | 273/194 R |
| 4,082,286 | 4/1978 | La Breche | 273/162 B |
| 4,415,159 | 11/1983 | Matheny et al. | 273/187 A |
| 4,482,155 | 11/1984 | Higley | 273/162 B |
| 4,795,157 | 1/1989 | Bencriscutto | 273/164.1 |
| 5,052,690 | 10/1991 | Sharp | 273/163 A |
| 5,058,891 | 10/1991 | Takeuchi | 273/163 A X |
| 5,158,297 | 10/1992 | Johnson | 273/187.4 |
| 5,184,817 | 2/1993 | Kanelous | 273/32 H |

*Primary Examiner*—George J. Marlo
*Attorney, Agent, or Firm*—Wood, Herron & Evans

[57] ABSTRACT

An alignment and set up teaching aid comprised of adhesive labels, for example, which are adapted to be placed on a golf club and which include symbols and/or indicia representing the proper foot placement, club head orientation, aiming area, target, weight placement and club head impact point. The symbols or indicia are universal within the teaching system provided in this disclosure in the sense that they may be used in different combinations depending on the shot to be executed, to give accurate representations of numerous shots which are not properly executed with a traditional set up and alignment designed for a level lie in the fairway. A further system of labels is provided for teaching proper putting guidelines.

10 Claims, 2 Drawing Sheets

UNIVERSAL GOLF ALIGNMENT AND SET UP TEACHING SYSTEM

BACKGROUND OF THE INVENTION

The present invention generally relates to a teaching aid or reminder system for golfers and, more specifically to a system set up and alignment diagrams which may be placed on golf equipment to remind golfers of the proper set up and alignment for a wide variety of golf shots.

One of the most difficult aspects of he game of golf relates to the enormous variety of shots that are required to be played during any given round. While it is one thing to learn the basics of a proper swing, it is quite another to implement the proper swing mechanics together with the proper set up and alignment for every situation. In this regard, sand lies, uphill lies, downhill lies, sidehill lies, lies in the rough, lies amongst the trees, etc., generally require different golfer and golf club alignment and sometimes a different impact point of the club head with respect to the ball in order to properly execute the desired shot. Often, many of these lies, or rather the shots that they call for, are referred to as "trouble shots". However, depending on the golf course and the golfer, such shots may actually be more commonly encountered during a round of golf than a level lie in the fairway which most golfers tend to practice and learn about the most.

As a result of golfers spending most or all of their practice time devoted to shots off of a level lie at a golf range, for example, they tend to learn only one type of alignment and set up with respect to the golf ball and target. Therefore, no matter what lie most golfers encounter on the golf course, they will tend to automatically align themselves or "set themselves up" as they learned at the golf range. Even relatively well-skilled golfers simply cannot remember the correct stance, alignment and club head orientation and proper impact point for every type of lie and required shot encountered on an actual golf course.

Certain golf alignment aids have been developed for use on golf equipment to help remind golfers of the "traditional" stance for different golf clubs. For example, U.S. Pat. No. 3,420,529, entitled "Golf Ball Including Stance Diagram", teaches a golf ball having eight different stance diagrams, each diagram corresponding to a different golf club and basically showing the relative positions of the golfer's feet, golf club and golf ball for each club. U.S. Pat. No. 3,684,294, entitled "Golf Club Including Stance Diagram" similarly discloses such basic "traditional" stance diagrams, except that they are placed on the golf club. While these alignment aids might be helpful to very novice golfers who cannot remember the basic set up for a level fairway lie, most golfers with any experience or training have these basic stances for level lies in the fairway committed to memory and therefore do not need reminding once on the course.

Another golf club having alignment indicia is disclosed in U.S. Pat. No. 5,158,297 (the '297 patent). The '297 patent discloses the use of a plurality of lines extending along the length of the club shaft for assisting the golfer in producing shots having incremental amounts of hook and slice. While the '297 patent is directed to teaching golfers such "non-traditional" golf shots as hooks and slices, it still fails to provide any means for reminding golfers of the several different set up and alignment modifications necessary to properly execute these shots as well as many other types of golf shots. Significantly, the system taught in the '297 patent does not indicate to the golfer what other set up modifications are necessary to have the sliced or hooked shot travel to the intended target, e.g., instead of slicing or hooking into trouble.

Further problems exist in the art of golf teaching aids aimed at helping golfers improve their putting. In this regard, while many alignment aids have been developed to help golfers align the putter head properly with respect to the hole, none of these alignment aids act as reminders for other putting basics which should be followed for successful putting.

It is therefore apparent that further improvements in the art of golf alignment and teaching aids are necessary, and that such improvements particularly should be directed to a quick and easy universal indicating system which golfers may use during a round of golf to properly set up and align themselves for a wide variety of shots.

SUMMARY OF THE INVENTION

To further improvements in the art, therefore, the present invention is generally directed to an alignment and set up teaching and reminding system comprised of adhesive labels, for example, which are placed on a golf club and which include indicating means or symbols, according to the principles of the present invention, which universally represent several key areas of proper alignment and set up for the many situations in the game of golf which cannot be successfully handled with a traditional set up and alignment designed for a level lie in the fairway, Specifically, the indicating means of the present invention respectively represent the target, the proper aiming area relative to the target, proper foot placement or stance, the golf ball, proper club head orientation, the proper club head impact point relative to the ball and, for some shots, the proper weight distribution on the golfer's feet. The symbols or indicating means are universal within the teaching system of the present invention in the sense that they may be used in different combinations depending on the combination necessary to execute a particular shot or handle a particular lie of the ball. As they are universal in this manner, they may be easily learned by the golfer and quickly applied on the golf course to help in executing any one of numerous different types of golf shots with the same club or with different clubs.

As mentioned above, the indicating means are preferably placed on adhesive labels which are then affixed, preferably in a removable fashion, to the club shaft of a golf club. As an example, five such adhesive labels may be affixed to the shaft of a sand wedge so as to teach and/or remind the golfer of the proper set up, alignment, and impact point for five different commonly experienced sand lies, e.g., a downhill lie, an uphill lie, a high lofted shot, a buried lie and a long explosion shot. Other labels, using generally the same indicating means as used in the sand shot labels, may be provided for instruction concerning other shots such as "fades" or "slices", "draws" or "hooks", high shots, low shots, shots out of the rough, etc. Although it is preferred that the indicating means be used on adhesive labels which may be applied to the golf club shafts as desired by the particular golfer, it is also contemplated that they may also be affixed to or part of the golf grip or affixed to other golf equipment such as golf bags and bag tags for ready access during a round of golf.

The invention further comprises a similar set of labels having further indicating means for teaching and/or reminding the golfer of proper putting guidelines. As with the indicating means used on the labels for other golf clubs, these indicating means provide easily recognized cues for the golfer which may be used during the round to improve his or her game.

It will therefore be appreciated after review of the details of the preferred embodiments provided herein that the present invention provides a universal teaching and reminding system which is easily learned and remembered by the golfer. Moreover, a system and method of learning the proper alignment and set up for the large number of different lies encountered on a golf course and the large number of different types of shots required is provided in such a way that the golfer can quickly recognize the proper execution of almost every shot required during the round.

Further advantages of the invention will become more readily apparent from the following detailed description taken in conjunction with the accompanying drawings of the preferred embodiments.

DETAILED DESCRIPTION OF THE PREFERRED EMBODIMENTS

Figure 1:
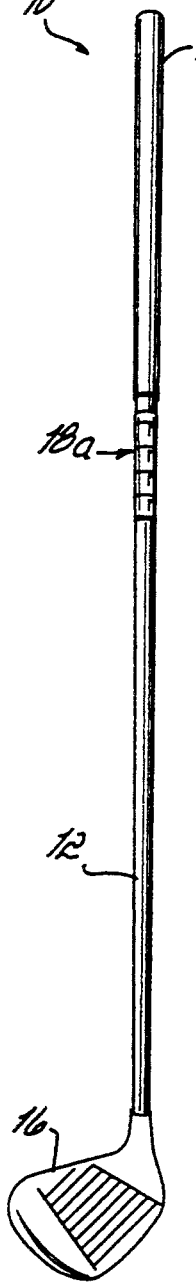
FIG. 1 is a perspective view of a sand wedge iron or golf club having an adhesive label or labels including the indicating means of the present invention secured to the shaft.

FIG. 1 illustrates a conventional golf club iron 10. In the specific example provided by FIG. 1, the iron 10 is a sand wedge having a shaft 12, a grip 14 and a club head 16. In accordance with the present invention, shaft 12 includes a segmented label or a plurality of separate labels 18*a* affixed thereto. Preferably, label 18*a* comprises a removable adhesive label having a plurality of different segmented areas in which different set ups, alignments, impact points, aiming areas, weight distributions, etc., are displayed by way of indicia means to be described. It will be appreciated that labels 10 and the indicia means to be described could alternatively be made part of the grip 14 or of a golf bag, for example, but in most instances it is preferable to place them directly on the most appropriate club or clubs for convenient and quick access as will be appreciated. Further, the description provided herein for the various indicia means will be in relation to a right handed golfer, however, those of ordinary skill will readily recognized that they may essentially be reversed in design for left handed golfers.

Figure 2:
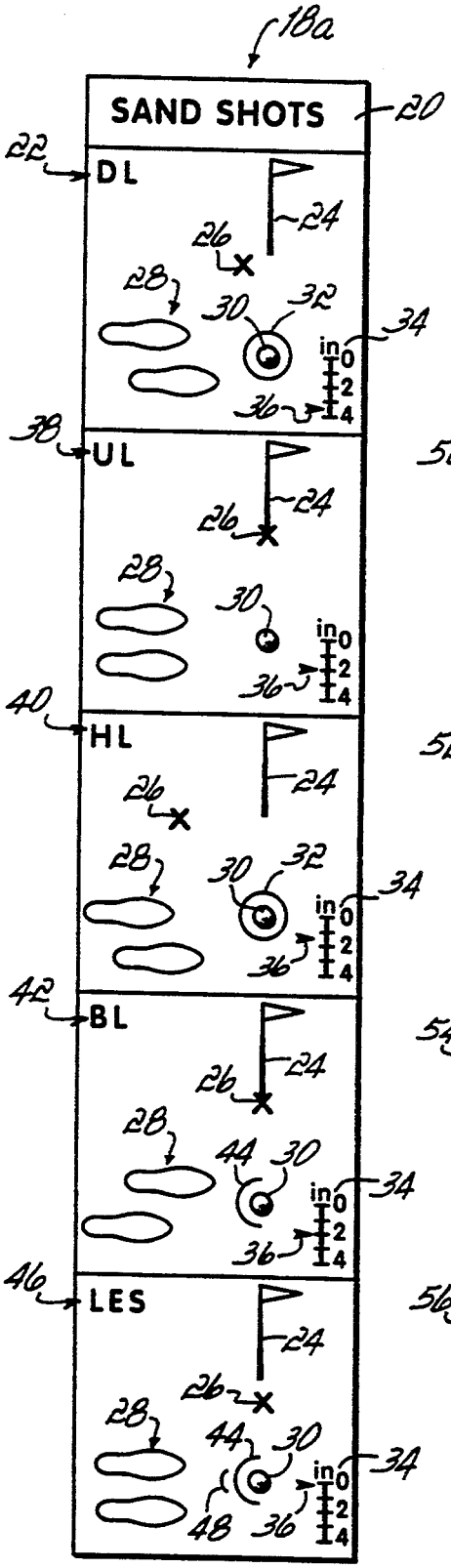
FIG. 2 is an elevated front view of the label or labels of FIG. 1 enlarged to show the universal indicating means of the present invention arranged to represent a set up, alignment and impact point for five different sand shots.

Specifically referring to FIG. 2, label 18*a* may include a title block 20 as shown. In the preferred embodiment of the invention with respect to sand shots made around the green, for example, a first segment 22 of label 18*a* is designated by shot or lie indicating means comprising the letters "DL" which indicate that segment 22 represents the correct set up, alignment, impact point, and club face orientation for a "downhill lie" in the sand trap. In accordance with this invention, segment 22 includes indicia means 24 representing the intended target, indicia means 26 comprising an "X" representing the proper aiming area with respect to the intended target indicia means 24, indicia means 28 representing the "stance" or, in other words, the correct placement of the golfer's feet relative to one another, and golf ball indicia means 30 representing the correct placement of the golf ball with respect to the target, aiming area and stance as represented, respectively, by indicia means 24, 26 and 28. In addition, indicia means 32 is provided in the form of a circle or "O" around the golf ball indicia means 30, which indicates to the golfer that the correct orientation of the club head 16 (FIG. 1) at address and at impact is an "open" faced orientation. Finally, indicia means 34, 36 are provided for indicating the proper impact point of the club head relative to the golf ball. This impact point indicating means preferably takes the form of a scale 34 representing distances in inches extending behind the ball at which impact should be made with the sand. Indicia means 36 is preferably an arrow which points to the approximate distance behind the ball at which impact should be made for the particular shot. It will be appreciated that the arrow 36 will point to "0" on scale 34 for most shots so as to remind the golfer to strike the ball first and not the ground, however, this is not the case with all shots, especially sand shots.

In the example given in segment 22 for a sand shot in which the golf ball has a downhill lie, it is thus easily seen that a proper manner of playing a downhill sand shot includes aiming left of target 24 as shown by aiming area indicia means 26 and using an open stance, or one in which the left or front foot is farther from the ball than the right or back foot as shown by stance indicia means 28. Also, the ball should be placed midway between the feet as shown by golf ball indicia means 30 relative to stance indicia means 28. The club face should be placed at an "open" orientation as shown by club face orientation indicia means 32. Finally, the club head should impact the sand approximately 3–4 inches behind the ball as shown by impact point indicia means 34, 36.

The example given in segment 38 of label 18*a* is designated by indicia means comprising the letters "UL" which refer to an "uphill lie" in the sand trap. For this type of sand shot, it will thus be readily understood that the golfer should aim directly at the target, as indicated by aiming area indicia means 26, or an "X", being placed directly in line with target indicia means 24. In addition, the golfer should take a "square stance" as represented by stance indicia means 28 and should impact the sand approximately two inches behind the ball as indicated by impact point indicia means 34, 36 relative to golf ball indicia means 30. Also, the ball should be placed midway between the golfer's feet as indicated by golf ball indicia means relative to stance indicia means 28. Finally, the fact that there is no indicia means, such as indicia means 32 shown in segment 22, around golf ball indicia means 30 indicates to the golfer that the club face orientation should be neither "open" nor "closed" but should be "square" or perpendicular relative to the target.

Segment 40, represented by the letters "HL", illustrates that for a high lofted shot from the sand, the golfer should aim well left of the target as indicated by the relative positions of indicia means 24 and 26. In addition, the golfer should take an "open" stance and the club face should have an open orientation as respectively indicated by indicia means 28 and 32. Finally, the ball should be placed approximately in line with the front or left foot of the golfer and the club head should impact about 1–2 inches behind the ball as indicated respectively by golf ball indicia means 30 relative to feet indicia means 28 and impact point indicia means 34, 36 relative to golf ball indicia means 30.

Segment 42, represented by the letters "BL", illustrates that for a "buried lie" in the sand, the golfer should aim directly at the target as indicated by the relative positions of indicia means 24 and 26. In addition, the golfer should take an "closed" stance and the club face should have a "closed" orientation as respectively indicated by indicia means 28 and 44. In regard to indicia means 44, a half circle or "C" has been placed around golf ball indicia means 30 to indicate a "closed" club face orientation. It will be appreciated that, as an "0" has been used for indicia means 32 to indicate an "open" club face, a "C" will be easily associated with a "closed" club face orientation by the golfer. Finally, the ball should be placed approximately in line with the front or left foot of the golfer and the club head should impact just behind the ball as indicated respectively by golf ball indicia means 30 relative to stance indicia means 28 and impact point indicia means 34, 36 relative to golf ball indicia means 30.

Segment 46, represented by letters "LES", illustrates that for a "long explosion shot" from the sand, i.e., one in which the golfer may be up to 50 yards from the hole, the golfer should aim at the target as indicated by the relative positions of indicia means 24 and 26. In addition, the golfer should take an "square" stance and the club face should have a "slightly closed" orientation as respectively indicated by indicia means 28 and 44, 48. In this latter regard, the smaller curved line comprising indicia means 48, when placed adjacent to the larger "C" comprising indicia means 44, indicates a "slightly" closed club face orientation. It will become more readily apparent from the further description below that indicia means "48" may likewise be used to indicate "slightly" open or closed stances as well as a "slightly" open club face orientation. Finally, segment 46 indicates that the ball should be placed closer to the front or left foot than to the back or right foot of the golfer and that the club head should impact approximately at the ball as indicated respectively by golf ball indicia means 30 relative to stance indicia means 28 and impact point indicia means 34, 36 relative to golf ball indicia means 30.

Figure 3:
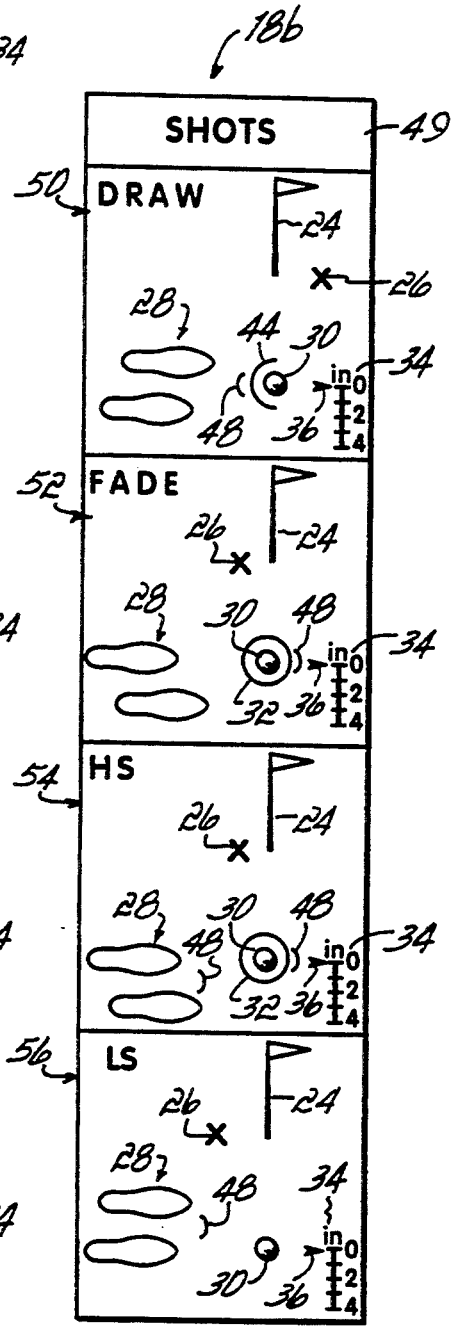
FIG. 3 is an elevated front view of another set of labels showing the universal indicating means of the present invention arranged to represent a set up, alignment and impact point for various shots including a "draw", a "fade", a high shot and a low shot.

FIG. 3 illustrates an adhesive label 18b illustrating proper set up, alignment, club face orientation and impact point for various types of golf shots, not necessarily made from a sand trap as with the sand shots represented in label **18*a*. Thus, title block 49 may simply read "SHOTS". Specifically, segment 50 represents a "draw", or right to left shot for a right handed golfer. Segment 52 represents a "fade", or left to right shot for a right handed golfer. Segment 54 represents a "high shot" as indicated by the letters "HS" and segment 56 represents a "low shot" as indicated by the letters "LS". Generally, all of these shots require direct impact with the ball as indicated by indicia means 34, 36**.

With specific regard to "draw" segment 50, aim should be right of the target as indicated by indicia means 24, 26. The stance should be closed as indicated by stance indicia means 28. The club face orientation should be slightly closed as indicated by indicia means 44, 48 and the ball should be placed closer to the left foot than to the right foot as indicated by golf ball indicia means 30 relative to stance indicia means 28.

Fade segment 52 indicates that aim should be left of the target as indicated by indicia means 24, 26. The stance should be open as indicated by stance indicia means 28. The club face orientation should be slightly open as indicated by indicia means 32, 48 and the ball should be placed closer to the left foot than to the right foot as indicated by golf ball indicia means 30 relative to stance indicia means 28.

High shot segment 54 indicates that aim should be somewhat left of the target as indicated by the relative positions of indicia means 24 and 26. The stance should be slightly open as indicated by stance indicia means 28 taken in conjunction with indicia 48 associated therewith for indicating the lower degree of an open stance that is necessary for a high shot. The club face orientation should be slightly open as indicated by indicia means 32, 48 and the ball should be placed substantially in line with the left foot as indicated by golf ball indicia means 30 relative to stance indicia 28.

Low shot segment 56 indicates that aim should be somewhat left of the target as indicated by the relative positions of indicia means 24 and 26. The stance should be slightly closed as indicated by stance indicia means 28 taken in conjunction with indicia 48 associated therewith for indicating a lesser degree closed stance that is necessary for a low shot. The club face orientation should be square as indicated by the lack of any indicia surrounding golf ball indicia 30 and the ball should be placed substantially in line with the right or rear foot as indicated by golf ball indicia means 30 relative to stance indicia means 28.

Figure 4:
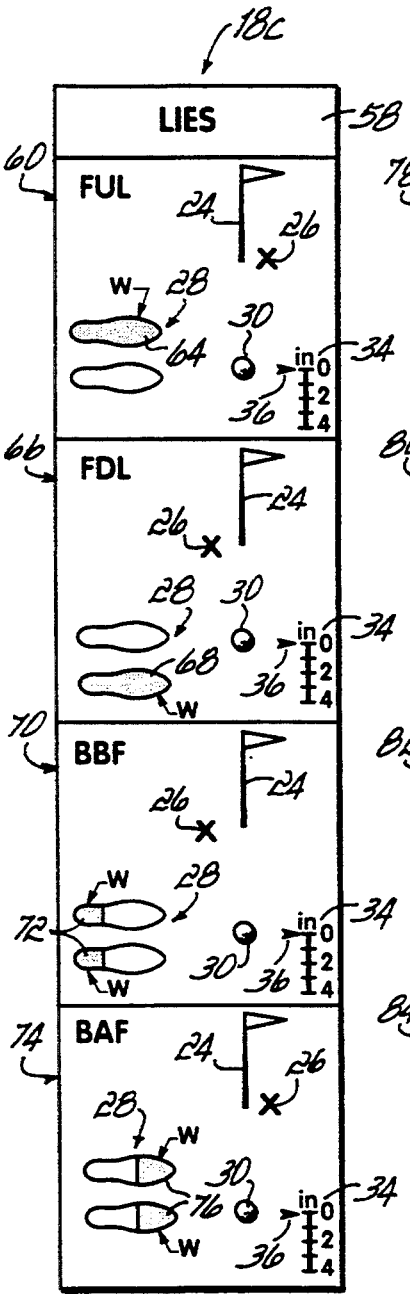
FIG. 4 is an elevated front view of another set of labels showing the universal indicating means of the present invention arranged to represent a set up, alignment, impact point and weight distribution for various lies including an uphill lie, a downhill lie, a sidehill lie with the ball below the golfer's feet and a sidehill lie with the ball above the golfer's feet.

FIG. 4 illustrates an adhesive label **18*c* illustrating proper set up, alignment, club face orientation, impact point and weight distribution for various types of golf ball lies. Title block 58 therefore simply reads "LIES". Specifically, segment 60 represents a "fairway uphill lie" as indicated by the letters "FUL". Segment 66 represents a "fairway downhill lie" as indicated by the letters "FDL". Segment 70 represents a sidehill lie in which the ball lies below the golfer's feet as indicated by the letters "BBF" and segment 74 represents a sidehill lie in which the ball lies above the golfer's feet as indicated by the letters "BAF". Generally, all of these shots require direct impact with the ball as indicated by indicia means 34, 36. Further indicia means comprising the letter "W" and shading 64 is included in connection with stance indicia means 28 for indicating the proper weight distribution of the golfer for each of these lies. More specifically, these weight distribution indicia means comprise indicating with the letter "W" and shading the area or areas on feet indicia 28** upon which the golfer should apply more weight.

For the uphill lie of segment 60 the golfer should aim right of the target as indicated by indicia 24, 26. The stance should be square as indicated by stance indicia means 28 and the club face orientation should be square as indicated by the lack of any indicia surrounding golf ball indicia 30. The ball should be placed substantially in line with the right or rear foot as indicated by golf ball indicia means 30 relative to stance indicia means 28 and more weight should be placed on the left foot than on the right foot as indicated by the "W" and shading 64.

For the downhill lie of segment 66 the golfer should aim left of the target as indicated by indicia 24, 26. The stance should be square as indicated by stance indicia means 28 and the club face orientation should be square as indicated by the lack of any indicia surrounding golf ball indicia 30. The ball should be placed substantially in line with the left or front foot as indicated by golf ball indicia means 30 relative to stance indicia means 28 and more weight should be placed on the right foot than on the left foot as indicated by both the "W" and shading 68.

For a sidehill lie in which the ball is below the golfer's feet, segment 70 shows that the golfer should aim left of the target as indicated by indicia 24, 26. The stance should be square as indicated by stance indicia means 28 and the club face orientation should be square as indicated by the lack of any indicia surrounding golf ball indicia 30. The ball should be placed substantially midway between the feet as indicated by golf ball indicia means 30 relative to stance indicia means 28 and more weight should be placed on the heels of both feet than on the toes as indicated by the two "W"s and shading 72.

For a sidehill lie in which the ball is above the golfer's feet, segment 74 shows that the golfer should aim right of the target as indicated by indicia 24, 26. The stance should be square as indicated by stance indicia means 28 and the club face orientation should be square as indicated by the lack of any indicia surrounding golf ball indicia 30. The ball should be placed closer to the right or rear foot than to the left or front foot as indicated by golf ball indicia means 30 relative to stance indicia means 28. More weight should be placed on the toes of both feet than on the toes as indicated by the two "W"s and shading 76.

Figure 5:
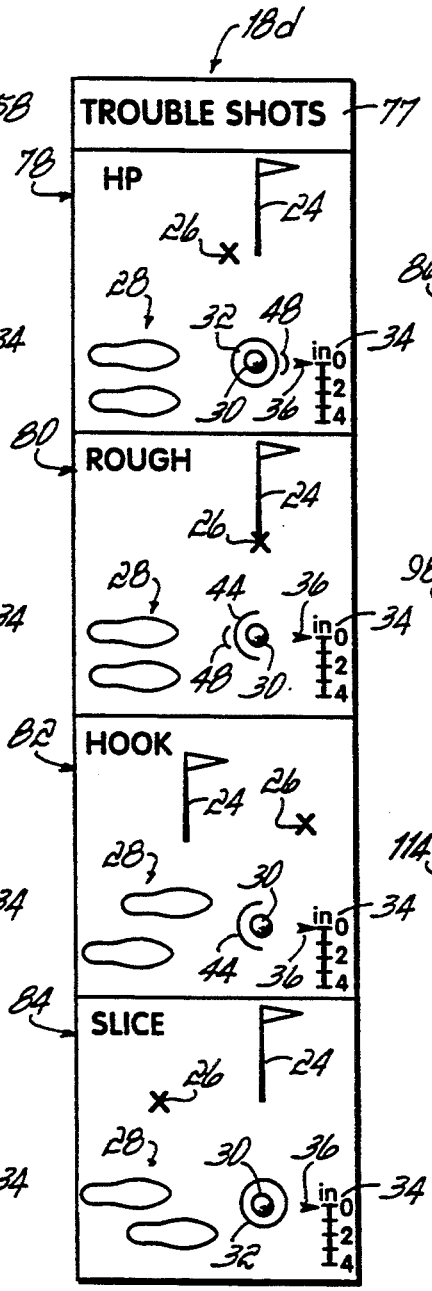
FIG. 5 is an elevated front view of another set of labels showing the universal indicating means of the present invention arranged to represent a set up, alignment and impact point for various trouble shots including shots off of "hard pan" and out of the rough as well as hook and slice shots; and, FIG. 6 is an elevated front view of another set of labels placed on a putter and showing indicating means for reminding golfers of proper putting guidelines.

FIG. 5 shows the teaching system of the present invention on an adhesive label **18*d* directed to shots which might more appropriately be termed "trouble shots" as indicated by the heading 77. Specifically, segment 78 is directed to a golf shot off of "hard pan" or "HP" which is generally taken to mean a shot in which the golf ball is resting on compacted dirt. Segment 80 is directed to a shot from the "rough" or, in other words, from long grass. Segments 82 and 84** are directed to intentional "hook" and "slice" shots which might, for example, be used to curve the ball around an obstacle such as a tree or group of trees.

As each of segments 78, 80, 82, 84 utilize various combinations and placements of indicia means 24, 26, 28, 30, 32, 34, 36, 44 and 48, all as previously explained, to represent the proper set up, alignment, etc. for the respective shots, further detailed explanation is not necessary. With respect to the relative positions of indicia 24 and 26 for the "hook" and "slice" segments 82, 84, however, it will be appreciated that increased distance therebetween has been shown, as compared to other previously described label segments, to indicate an aiming area farther to one side of the target or another. This is because a trouble shot involving a "slice" or "hook" will bend or curve more in the air than any other shot. Likewise, the open and closed stance indicia means 28 respectively shown in "hook" and "slice" segments 82, 84 are exaggerated as compared with the stance indicia means 28 for the related, but less sharply curving, "draw" and "fade" shots represented by segments 50 and 52 of FIG. 3.

Figure 6:
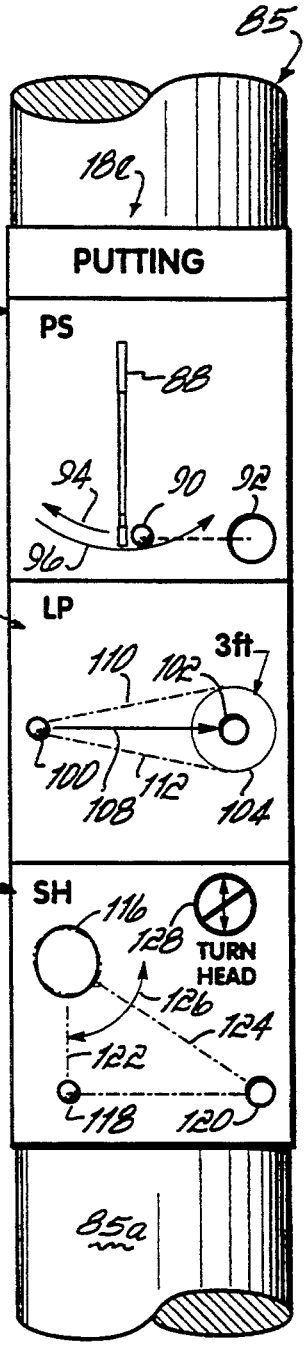

Finally, in accordance with another aspect of this invention, an adhesive label **18*e* is provided and preferably placed on the shaft 85*a* of a putter 85, as shown in FIG. 6, for teaching particular putting guidelines. More specifically, segment 86 illustrates indicia for reminding the golfer to use a pendulum type swing as indicated by the letters "PS". In this regard, segment 86 includes putter indicia 88, golf ball indicia 90 and golf hole indicia 92 lined up generally illustrating an address position. A curved arrow 94 is directed rearwardly away from putter indicia 88 and another curved arrow 96 is directed parallel to arrow 94 and then forwardly past the golf ball indicia 90**. Together, these indicia remind the golfer to use a "pendulum" style putting stroke.

Segment 98, designated with the letters "LP", reminds a golfer attempting a long "lag" putt that an appropriate goal is to putt the ball within three feet of the hole. Segment 98 includes golf ball indicia 100, golf hole or cup indicia 102 a circle 104 around cup indicia 102 which indicates the three foot diameter in which the ball should come to rest. An arrow 108 leads from ball indicia 100 to cup indicia 102 and lines 110, 112 lead from ball indicia 100 to opposite sides of circle 104 to illustrate that the ball may be hit somewhat off-line with respect to the cup and still end up within the acceptable three foot circle.

Segment 114, designated with the letters "SH", reminds a golfer not to lift their head to look at the cup while standing over the ball. Rather, the golfer should swivel or turn their head. Thus, indicia 116 representing the golfer's head is provided in addition to ball indicia 118 and cup indicia 120. Two lines 122, 124 which respectively represent the golfer's line of sight to the ball and to the cup while standing at address are provided along with an arrow 126 representing the proper swivelling motion of the head between the two lines of sight 122, 124. Finally, to reinforce the undesirability of lifting the head instead of turning the head while addressing the putt, indicia means 128 is provided on segment 114.

While preferred embodiments of this invention have been provided in detail, it is meant to be understood that modifications and substitutions thereto may be provided without departing from the spirit and scope of this invention. For example, the label segments may or may not be attached to one another as previously mentioned. For example, the sand shot segments may be connected to one another as these will often be placed only on the sand wedge and/or pitching wedge. Other label segments may be individual labels themselves and placed on some clubs and not others, depending on the needs of the golfer and the particular club. For example, a "low shot" label would usually be placed only on irons with low degrees of loft such as number "two" and "three" irons since one would not generally attempt a low shot with a highly lofted club. Also, the various indicia markings or symbols shown may be altered or markings other than those shown, but following the concepts laid out in this specification, may be substituted while still staying within the spirit of the invention. In regard to weight distribution indicia in the form of a "W" and in the form of shading, either one or both may be used while still achieving the object of this aspect of the invention. Finally, while a rather large representative sampling of shots and lies have been disclosed herein, it will be understood that many further combinations of the universal indicia means of FIGS. 2–5 may be readily constructed in accordance with this invention for other shots and lies. Even those diagrams shown herein may be modified according to other philosophies of thought as to the "correct" setup, alignment, etc., for a particular shot.

Thus, while detailed preferred embodiments have been provided herein, Applicant intends to be bound only by the scope of the appended claims.

What is claimed is:

1. A golf shot teaching and reminding system comprising a plurality of labels having means for affixing each said label to an item of golf equipment, each label including a plurality of golf alignment and set up indicia means on a face thereof, said alignment and set up indicia means including target indicia means for representing an intended target for a golf shot, aiming area indicia means placed on the face of said label at a location with respect to said target indicia means which indicates an intended aiming area relative to said intended target, stance indicia means placed on the face of said label for representing a golfer's stance in proper relation to said aiming area indicia means and said target indicia means for a predetermined golf shot or lie, and golf ball indicia means placed on the face of said label for representing a golf ball in proper relation to said stance indicia means, aiming area indicia means and target indicia means for said predetermined shot or lie.

2. The golf shot teaching and reminding system of claim 1 further comprising club face orientation indicia means on the face of at least one of said plurality of labels for representing one of an open and closed club face orientation for said predetermined shot or lie.

3. The golf shot teaching and reminding system of claim 2 wherein said club face orientation indicia means represents an open club face orientation and comprises circle-shaped indicia means placed around said golf ball indicia means.

4. The golf shot teaching and reminding system of claim 2 wherein said club face orientation indicia means represents a closed club face orientation and comprises C-shaped indicia means placed around said golf ball indicia means.

5. The golf shot teaching and reminding system of claim 1 further comprising impact point indicia means placed on the face of at least one of said plurality of labels in a position with respect to said golf ball indicia means which represents a proper club head impact point with respect to said golf ball.

6. The golf shot teaching and reminding system of claim 5 wherein said impact point indicia means comprises a scale graduated in discrete distance increments and placed on the face of said at least one label and extending from said golf ball indicia means in a direction away from said target indicia means, and means for indicating one of said discrete increments as said proper club head impact point.

7. The golf shot teaching and reminding system of claim 1 further comprising weight distribution indicia means placed on the face of at least one of said plurality of labels and disposed in relation to said stance indicia means so as to indicate a proper weight distribution on the golfer's feet for a predetermined golf shot.

8. The golf shot teaching and reminding system of claim 7 wherein said weight distribution indicia means comprises shading on said stance indicia means for indicating where more weight should be placed in one portion of said stance relative to other portions of said stance.

9. The golf shot teaching and reminding system of claim 7 wherein said weight distribution indicia means comprises a "W" placed on the face of said at least one label and indicating means extending from said "W" to a portion of said stance indicia means for indicating where more weight should be placed in one portion of said stance relative to other portions of said stance.

10. The golf shot teaching and reminding system of claim 1 further comprising shot designating indicia means on each said label for indicating the type of shot represented on each said label.

* * * * *

UNITED STATES PATENT AND TRADEMARK OFFICE

CERTIFICATE OF CORRECTION

PATENT NO. : 5,427,370

DATED : June 27, 1995

INVENTOR(S) : Hamblin et al.

It is certified that error appears in the above-indentified patent and that said Letters Patent is hereby corrected as shown below:

Col. 1, line 12, "he" should be -- the --.

Col. 9, line 27, after "equipment" insert -- used in playing a round of golf --.

Col. 9, line 30, "for" should be deleted.

Col. 9, line 34, delete "an" and insert therefor --a proper --.

Col. 9, line 36, "for" should be deleted.

Col. 9, line 36, after "golfer's" insert -- feet in proper --.

Col. 9, line 36, delete "in proper" before "relation".

Col. 9, line 38, delete "and" and insert therefor -- circular --.

Col. 9, line 39, delete "for".

UNITED STATES PATENT AND TRADEMARK OFFICE

CERTIFICATE OF CORRECTION

PATENT NO. : 5,427,370

DATED : June 27, 1995

INVENTOR(S) : Hamblin et al.

It is certified that error appears in the above-indentified patent and that said Letters Patent is hereby corrected as shown below:

Col. 9, line 42, after "lie" insert --, and said alignment and set up indicia means being different on each of said labels to represent different golf shots or lies so that when properly affixed to said golf equipment, said labels may be readily viewed by a golfer during a round of golf as a reminder of the proper set up and alignment when faced with such different golf shots or lies --.

Signed and Sealed this

Twenty-third Day of January, 1996

*Attest:*

Bruce Lehman

BRUCE LEHMAN

*Attesting Officer*

*Commissioner of Patents and Trademarks*